United States Patent [19]

Kikuchi et al.

[11] Patent Number: 4,917,614

[45] Date of Patent: Apr. 17, 1990

[54] ELECTRICAL CONNECTOR FOR SURFACE MOUNTING ONTO CIRCUIT BOARDS

[75] Inventors: Shoji Kikuchi, Hiratsuka; Nobuaki Onoue, Sagamihara; Junichi Tanigawa, Kawasaki, all of Japan

[73] Assignee: AMP Incorporated, Harrisburg, Pa.

[21] Appl. No.: 186,497

[22] Filed: Apr. 26, 1988

[30] Foreign Application Priority Data

May 12, 1987 [JP] Japan ..... 62-115684
Aug. 14, 1987 [JP] Japan ..... 62-202993

[51] Int. Cl.[4] ..... H01R 9/09
[52] U.S. Cl. ..... 439/83; 439/874
[58] Field of Search ..... 439/81–83, 439/629, 632, 874, 875, 877, 876

[56] References Cited

U.S. PATENT DOCUMENTS 3,871,736 3/1975 Carter ..... 339/17 CF
4,577,922 3/1986 Stipanuk et al. ..... 439/83
4,645,279 2/1987 Grabbe et al. ..... 339/17 CF
4,682,829 7/1987 Kunkle et al. ..... 439/83
4,693,528 9/1987 Asick et al. ..... 439/83
4,695,106 9/1987 Feldman et al. ..... 439/83
4,718,859 1/1988 Gardner ..... 439/493

*Primary Examiner*—P. Austin Bradley

[57] ABSTRACT

An electrical connector (21) comprises a dielectric housing (20) having apertures in which contact sections (6) of electrical contacts (2) are secured while termination sections (10) of the contacts (2) extend at a 45 degree angle with respect to the contact sections (2) and along a bottom surface (23) of the housing (20) so that the termination sections (10) are parallel and extend outwardly from at least one of the side walls of the housing (20) for connection to conductive members on a circuit board. Connector (40), 40*a–c*) is provided with contacts (2*a*) having tines (34) for disposition in holes (32) in a circuit board (31) for connection to conductive areas on a bottom surface (31″) of the board while termination sections of contacts (2) are connected to conductive areas on an upper surface (31′) of the board (31).

9 Claims, 7 Drawing Sheets

ELECTRICAL CONNECTOR FOR SURFACE MOUNTING ONTO CIRCUIT BOARDS

FIELD OF THE INVENTION

The present invention relates to an electrical connector. In particular, it is related to an electrical connector for surface mounting onto a circuit board to effect an electrical connection between printed circuit boards or between a printed circuit board and electronic parts.

BACKGROUND OF THE INVENTION

In order to make an electrical connection between a printed circuit board and electronic parts or between printed circuit boards, it is known to use a pair of mating connectors having a plurality of male and female contacts respectively included in the housings thereof, wherein the connectors and a plurality of contacts thereof are electrically mated at the same time during engagement of these housings.

As a recent trend in the electronics industry, surface mount electrical connectors are widely used because of their high mounting density and simple soldering process. The surface mount electrical connector is however only soldered to a conductive part of the printed circuit board, and the printed circuit board and the contacts are apt to be disconnected by an excessive force exerted when the male contacts are inserted into the female contacts in comparison with through hole type contacts.

Also, since a number of contacts are included in the connector, an excessive force is exerted when the male contacts are inserted into the female contacts, thus the contact sections of the female contacts are apt to be deformed or damaged.

Therefore, the purpose of this invention is to provide female contacts having a high reliability, by which damage to the connecting portion between the contact and the printed circuit board can be avoided by preventing the exertion of an excessive force on the female contact when the male contact is inserted therein.

SUMMARY OF THE INVENTION

According to the present invention, an electrical contact comprises a contact section having opposing contact members, an intermediate section having a terminating section to be terminated to a conductive member of a printed circuit board, the terminating section extending at an angle with respect to the intermediate section which links the contact section and the terminating section. According to this invention, the direction in which the terminating section is extended and the arrangement of the contact member alleviates the effect of an excessive force exerted when the male contact is inserted between the contact members. Moreover, since the terminating section is joined to the contact section by a cantilever structure, forces on the connection between the terminating section and the conductive member of the circuit board can be reduced.

This invention also comprises an electrical connector including an electrical contact and a dielectric housing, the contact having a contact section including opposing contact members, a terminating section for termination to a conductive member of a printed circuit board, and an intermediate section which links the contact section and the terminating section and wherein the terminating section extends at an angle to the intermediate section. The housing has side walls which surround the contact sections, and a bottom along which the terminating section of the contacts extend. The contact members of the contact sections are arranged at an angle with respect to each side wall of the housing. Since the arrangement of the contact members of the contact sections in the connector housing does not accord with the direction in which the contact sections extend toward each side wall surrounding the contact sections, the disposition of the male contacts does not accord with the arrangement of the contact members at the time of the engagement of the connectors, and thus the contact members are not directly affected by any excessive force exerted thereon.

According to another aspect of the present invention, an electrical connector comprises electrical contacts secured in a dielectric housing having contact sections disposed in respective apertures in the housing and terminating sections that extend along the bottom wall of the housing with some of the terminating sections having terminating portions being surface mountable onto conductive areas on one side of a circuit board while other terminating sections have tines that extend through holes in the circuit board and are connectable to conductive areas on the other side of the circuit board. Such a connector improves the strength and reliability when connected to a circuit board in addition to a connector that is highly suitable for high density applications. The short paths provided by the terminating sections result in lower impedance connections for high frequency terminations.

BRIEF DESCRIPTION OF THE DRAWINGS

The invention, together with objects and advantages thereof, is best understood by way of example with reference to the following detailed description in conjunction with the accompanying drawings.

FIG. 3 is a top plan view of the contact.

DETAILED DESCRIPTION OF THE INVENTION

Figure 1:
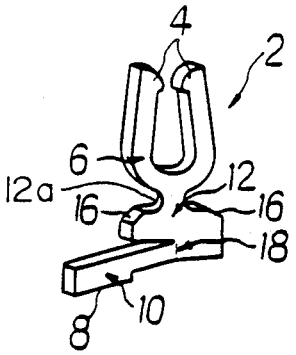
FIG. 1 is a perspective view of an electrical contact of this invention.
Figure 2:
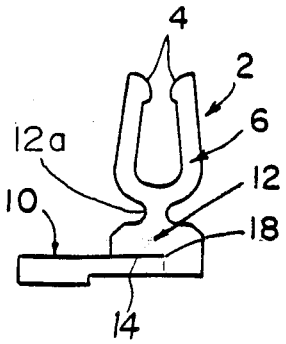
FIG. 2 is a side elevational view of the contact.

FIGS. 1 to 3 show a surface mount female electrical contact 2 which is a preferred embodiment of this invention. Contact 2 has a contact section 6, an intermediate or base section 12 and a terminating section 10. Contact section 6 is a female contact section and is U-shaped with opposing contact members 4. Intermediate section 12 is press-fitted and fixed in an aperture in a connector housing thereby securing contact 2 in the connector housing so that terminating section 10 having a terminating portion 8 can be terminated to a conductive member of a printed circuit board. Intermediate section 12 also links contact section 6 and terminating section 10.

Contact 2 is stamped and formed from a strip of suitable conductive metal having a predetermined thickness, and a slit 14 is formed at a portion of intermediate section 12. Terminating section 10, as shown in FIG. 2, extends at an angle of 45 degrees from an end 18 of slit 14 at which terminating section 10 and intermediate section 12 are linked. Accordingly, as shown in FIG. 3, which is a top plan view of contact 2, terminating section 10 extends at an angle of 45 degrees relative to the direction of contact members 4 of contact section 6. Thus, the inner end of termination section 10 is located at the insertion axis of contact section 6. Contact members 4 are formed into a U-shape, as in a conventional type contact, and thus can resisit a force exerted on each contact member when the contact member of the male contact is inserted between these contact members as they have an elasticity sufficient to firmly electrically engage the male contact member.

Intermediate section 12, which links contact section 6 to terminating section 10, is formed of a size suitable to be able to withstand the weight of the printed circuit board and the electronic parts that are electrically connected by contacts 2 and the male contacts after the contacts are electrically mated. The preferred embodiment is provided with shoulders 16 to support the weight mentioned above.

The contact members of the male contacts of a conventional electrical connector are arranged in the same direction as the terminating sections and are parallel with the side walls of the housing; accordingly, the male contact members force open the female contact members when the male contact members are inserted between the contact members of the respective female contacts. Therefore, force is exerted on separate contact members of the female contacts. Accordingly, a disconnection of the connection of the terminating portions with the conductive members on the circuit board is apt to occur because of an excessive force exerted at this time.

However, according to the preferred embodiment of this invention, since the terminating section 10 is positioned 45 degrees from the direction in which contact members 4 are arranged, the terminating portion 8 of terminating section 10 is not directly affected by such a force, and a force exerted by the male contact member can be greatly reduced when mating the male contact members with the contact members 4 because the force is exerted in a different direction to that in which contact members 4 are arranged. Thus, a possibility of disconnection of terminating portion 8 from a conductive member on the circuit board by an excessive force exerted at the time of insertion of the male contact members into contact members 4 of female contacts 2 and an incomplete connection due to deformation of contact members 4 is greatly reduced.

The following is an explanation of the preferred embodiment of the electrical connector in which the above-described contacts 2 are used.

Figure 4:
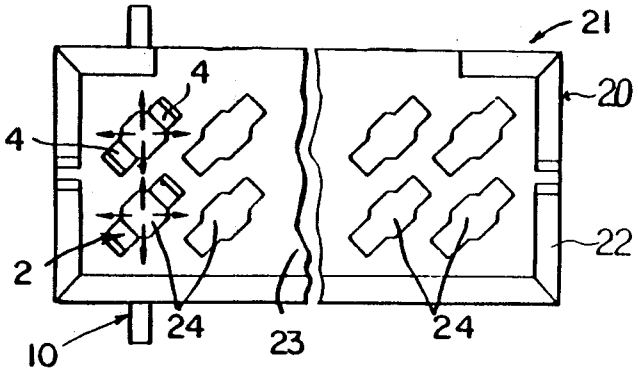
FIG. 4 is a top plan view of an electrical connector of this invention.

FIG. 4 shows a top plan view of an electrical connector 21 of the referred embodiment, in which only the left side row of contacts are shown, and other rows are shown as positions at which contacts 2 are to be located.

Electrical connector 21 includes the above-described electrical contacts 2 and housing 20 in which contacts 2 are secured. Housing 20 is a suitable dielectric material and is composed of side and end walls 22 surrounding contact sections 6 of contacts 2 and a bottom wall 23 having apertures 24 which extend into housing 20 in which contacts 2 are secured. End walls 22 have recessed and projecting surfaces which engage with projecting and recessed complementary surfaces of the housing of the male contacts, thus an insertion of the male contact members in the respective female contact members 2 is limited to a central vertical insertion between contact members 4, and both contacts are electrically engaged by the engagement of both connector assemblies.

Apertures 24 in housing 20 are profiled so as to be complementary to the shape of contact sections 6 and intermediate sections 12 of contacts 2. Apertures 24 communicate with channels 24*a* in the bottom wall along the outer surface thereof to accommodate termination sections 10 of contacts 2, as shown in FIG. 5.

Figure 5:
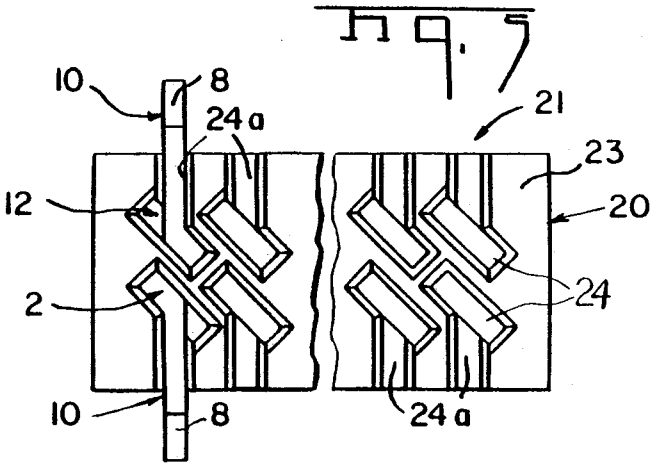
FIG. 5 is a bottom plan view of a housing of the connector.
Figure 6:
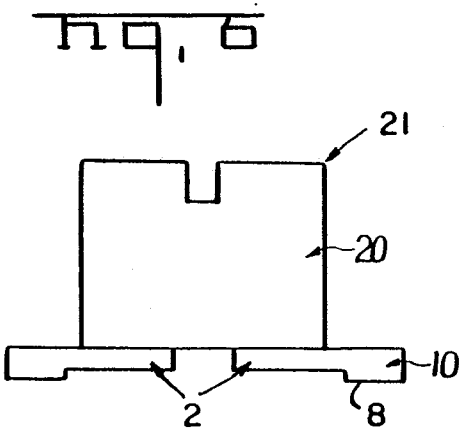
FIG. 6 is a side elevational view of the connector.
Figure 7:
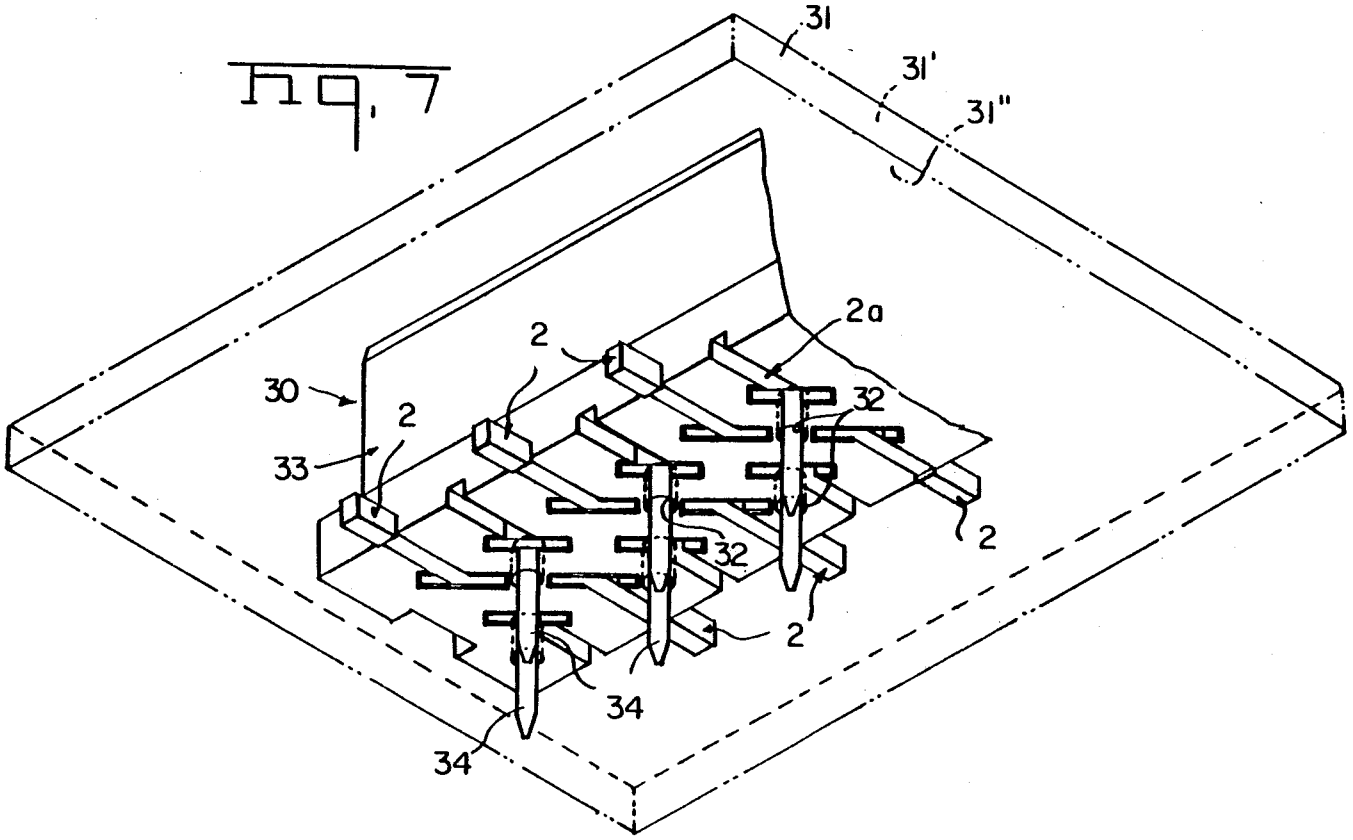

As shown in FIGS. 4 and 5, contacts 2 are arranged so that termination sections 10 are parallel to each other and end walls 22, and apertures 24 are profiled to correspond with the contact and termination sections of these contacts. Intermediate sections 12 of contacts 2 are secured within respective apertures 24 by press-fitting into apertures 24, and a portion of each termination section 10 is disposed in channels 24*a* while an exposed portion extends downwardly from bottom wall 23. FIG. 6 is a side view of connector 21 showing contacts 2 secured in housing 20. Termination sections 10 position bottom wall 23 above the circuit board when connector 21 is mounted thereon.

Note that, because contacts 2 are arranged as explained above, contact members 4 are always placed at an angle to each wall of housing 20. As explained previously, a plurality of contacts 2 are mated at the same time with male contacts when a pair of housings are engaged. The prior art connector, however, requires an excessive force at the time of insertion because of plurality of contacts are mated at the same time, therefore the direction of insertion is shifted by the affect of this force. Since the side walls of the housing are parallel, the forces exerted at the time of insertion of the male contacts are parallel with the side walls when the pair of housings are engaged; namely, they can be distributed in the vertical and lateral directions as shown by the arrows in FIG. 4.

The arrangement of contact members 4, according to the preferred embodiment of this invention, is not parallel with the direction in which end walls 22 extend but is at an angle of 45 degrees thereto, as shown in FIG. 4. Therefore, if a vertical or lateral misalignment during engagement between the male and female contacts occurs, the contact members of the male contacts always engage diagonally to the direction in which female contact members 4 are arranged, therefore an excessive force cannot be exerted on contact members 4. Also, in the case of the former connector, in which the arrangement of the female contact members is in accord with the disposition of the insert direction of the male contact members, the contact members are effected by an excessive force even though inserted at any angle because all of the contact members are moved out of position. This, however, does not apply to the angular dispostion of the contacts 2 in housing 20, therefore the possibility of damage to the contact members is substantially reduced.

Further, since connector 21 is composed of contact sections 6 arranged at an angle of 45 degrees to end walls 22 of housing 20, the width of the connector can be made narrower in comparison with the former connector; thus, the area occupied by the connector is reduced, which results in the mounting density of the whole printed circuit board being improved.

Moreover, intermediate sections 12 of contacts 2 are secured inside apertures 24 formed in bottom wall 23 of housing 20, therefore, contacts 2 do not define a cantilever structure.

A necked-down portion 12*a* of intermediate section 12 enables contact section 6 to have freedom of movement relative to intermediate section 12. Also, termination sections 10 are provided with slit 14 and the length of termination sections 10 is longer than that of the former contacts, therefore a force affecting terminating portions 8 can be easily absorbed by the elasticity of termination sections 10 so that disruption of the electrical connection with conductive members on the circuit board can be avoided.

Although the preferred embodiment is described above, the shape of the contact is not restricted. Further, the angle formed by the direction in which contact members 4 are arranged and the direction in which termination sections 10 extend is not limited to 45 degrees.

Also, any shape of connector can be used as long as the structure thereof can control the insertion direction and the position of the male contacts when a pair of housings are engaged. Moreover, if using a structure whereby the direction in which the side walls extend does not accord with the direction in which contact members are arranged, the same result of avoiding damage to the contact members can be obtained by utilizing a through hole type contact.

Figure 7:
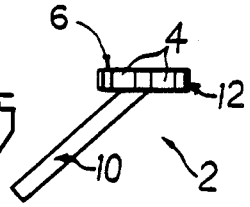
FIG. 7 is a perspective broken view of an alternative embodiment of the invention.

Connector 30, as shown in FIG. 7, shows an embodiment of electrical connector 21 with a circuit board 31 being shown in phantom to which connector 30 is to be mounted. Connector 30 is of the same construction as that of connector 21 with contacts 2 being disposed in every other aperture in each row of apertures in dielectric housing 33 so that the termination sections thereof are surface mountable to conductive areas on surface 31' of circuit board 31. In the other apertures in housing 33, contacts 2*a* having tines 34 instead of surface mount termination sections extend outwardly from the bottom surface of housing 33 coextensive with the axes of the apertures in which the contact sections of contacts 2*a* are secured. Tines 34 extend through holes 32 in circuit board 31 and extend outwardly from surface 31" thereof so as to be flow solderable to conductive areas on surface 31" or to conductive material in holes 32.

Contacts 2*a* are of the same construction as that of contacts 2 except that they have tines that are to be disposed in holes in a circuit board although they can also contain surface mount termination sections for surface mount termination sections for surface mount connection to conductive areas on surface 31' of circuit board 31, if desired.

Thus, the connector 30 of FIG. 7 has alternate contacts 2 provided with terminating sections extending along the bottom surface of and outwardly from respective sides of housing 33 at staggered locations therealong for surface mount electrical connection to conductive areas on surface 31' of circuit board 31 whereas tines 34 of contacts 2*a* extend outwardly from and normal to the bottom surface of housing 33 at staggered locations for disposition in respective holes 32 in circuit board 31 so as to be electrically connectable to conductive areas on surface 31' of circuit board 31. Such an arrangement will positively secure connector 30 on board 31 and accommodate high density applications. The short path terminations will result in lower impedance connections for high frequency terminations.

Figure 8A:
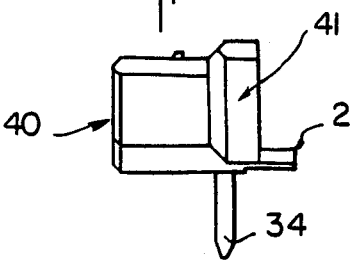
FIGS. 8A, 8B and 8C are side elevational, bottom plan and rear views, respectively, of a further embodiment of the invention.
Figure 8B:
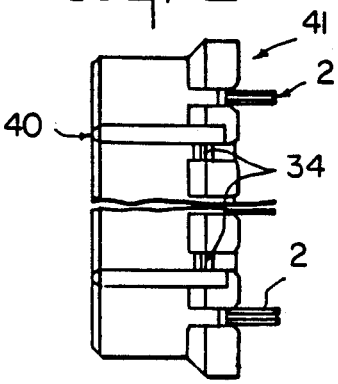
Figure 8C:
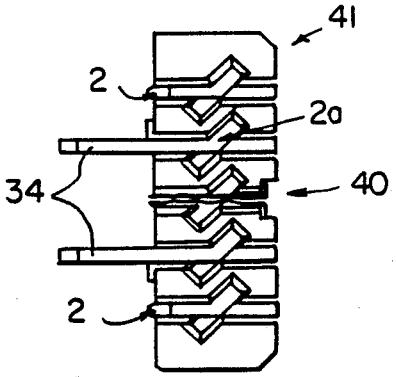

Connector 40, as shown in FIGS. 8A–8C, shows tines 34 of contacts 2*a* extending along recesses in the back surface of dielectric housing 41 in the same manner as the surface mount termination sections of contacts 2 do so that tines 34 extend outwardly from and normal to the bottom surface of housing 41 whereas the surface mount termination sections of contacts 2 extend outwardly from and normal to the back surface of housing 41 while also being in the same plane as that of the bottom surface of housing 41. As shown in FIG. 8C, the contact sections of contacts 2, 2*a* are in the same row with contacts 2, 2*a* alternating with one another. Connector 40 can therefore be mounted on a circuit board with its bottom surface in engagement therewith.

Figure 9A:
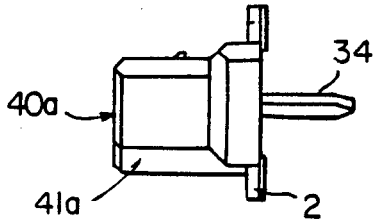
FIGS. 9A, 9B and 9C are side elevational, bottom plan and rear views, respectively of an additional embodiment of the invention.
Figure 9B:
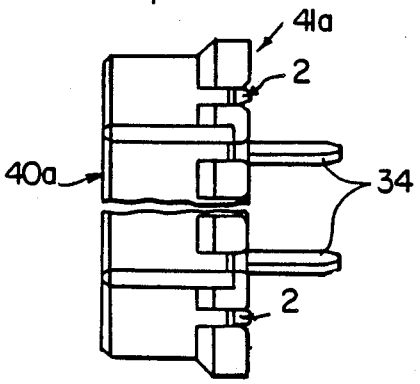
Figure 9C:
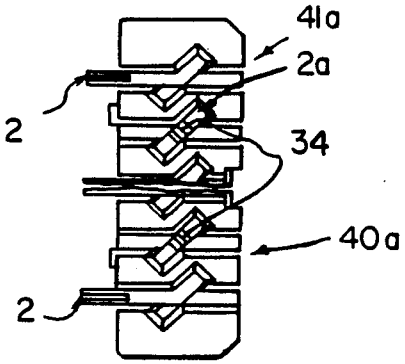

Connector 40*a* of FIGS. 9A–9C is the same as connector 40 of FIGS. 8A–8C except that tines 34 of contacts 2*a* extend outwardly from and normal to the rear surface of housing 41*a* along the axes of the apertures in which the contact sections of contacts 2*a* are secured so that connector 40*a* can be mounted on a circuit board with its back surface in engagement therewith.

Figure 10A:
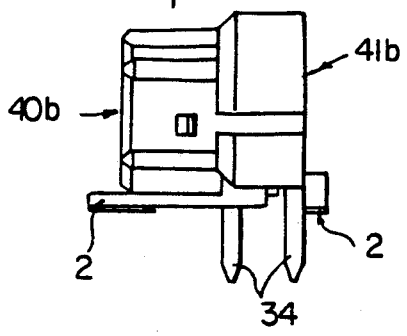
FIGS. 10A, 10B and 10C are side elevational, bottom plan and rear views, respectively of a still further embodiment of the invention.
Figure 10B:
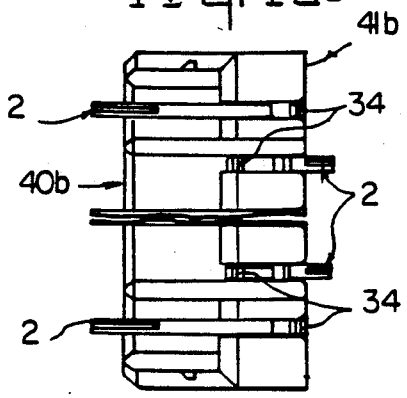
Figure 10C:
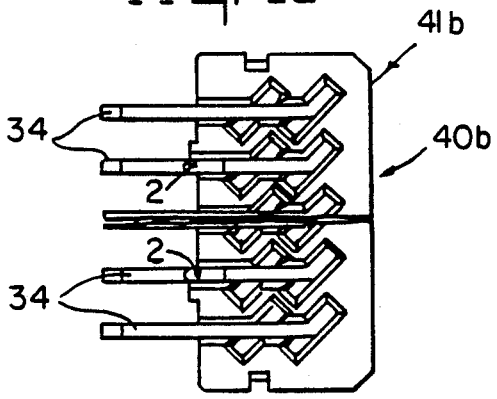

As shown in FIGS. 10A–10C, connector 40*b* has two rows of contacts 2, 2*a* with a surface mount termination section of every other contact 2 extending outwardly from the front surface of housing 41*b* and in alignment with tine 34 of a contact 2*a* while every other termination section of the other contacts 2 extend outwardly from the back of housing 41*b* also in alignment with tine 34 of a contact 2*a*.

As shown in FIG. 10B, the tines 34 of contacts 2*a* that are in alignment with the termination sections of contacts 2 that extends outwardly from the front surface of housing 41*b* are disposed in an outer row adjacent the back surface of housing 41*b* so that the outer surfaces of tines 34 in this outer row are in the same plane of the housing rear surface. Thus, every other tine 34 of contacts 2*a* is arranged in this manner. This leaves the other tines 34 of contacts 2*a* disposed in an inner row and in alignment with respective termination sections of contacts 2 that extend outwardly from the rear surface of housing 41*b*. Thus, connector 40*b* is mounted on a circuit board with its bottom surface extending along the board surface.

Figure 11A:
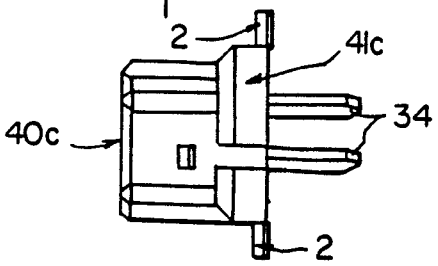
FIGS. 11A, 11B and 11C are side elevational, bottom plan and rear views of a still additional embodiment of the invention.
Figure 11B:
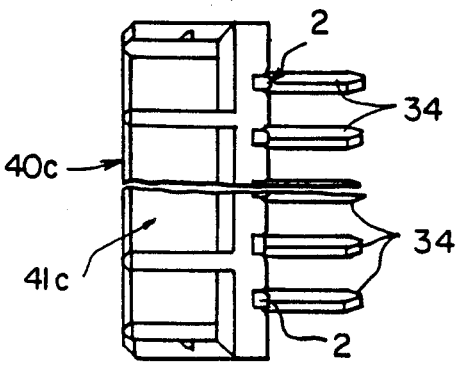
Figure 11C:
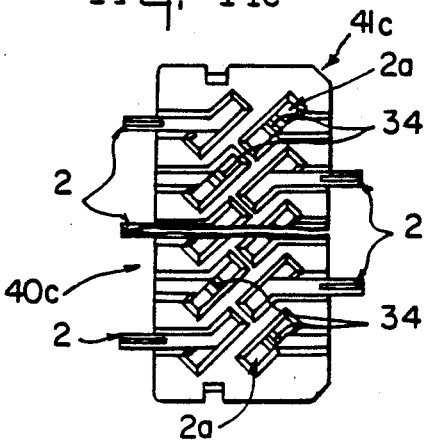

As regards connector 40*c* of FIGS. 11A–11C, every other tine 34 of contacts 2*a* is disposed in respective inner and outer rows in staggered relationship in alignment with respective termination sections of contacts 2 extending outwardly from front and rear surfaces of housing 41*c* so that the rear surface of connector 40*c* is mounted onto the board surface.

It is to be noted that tines 34 of contacts 2*a* of connectors 40 and 40*b* are disposed in channels in the outer surface of the bottom walls of housings 41, 41*b* in the same manner as the termination sections of contacts 2 and tines 34 are also disposed at 45 degrees with respect to the contact sections of contacts 2*a* in the same manner as the termination sections of contacts 2 are disposed with respect to the contact sections thereof.

As explained above, this invention provides a highly reliable electrical contact and connector by which an excessive force exerted on the female contact when the male contact is inserted can be alleviated, thus damage to the contact is prevented and the electrical connection between the contacts and the printed circuit board can be ensured.

We claim:

1. An electrical contact comprising:

an elongate termination section to be terminated at the outer end thereof to an electrically conductive area on an insulation board;

an intermediate section having a relatively large base portion linked to the inner end of said termination section at substantially a bottom center of said base portion and having a relatively narrow neck portion; and a contact section having substantially symmetrical opposing contact members coupled to said neck portion of said intermediate section for resiliently receiving a contact pin between said opposing contact members;

wherein said termination section is long enough so that the outer end thereof extends from the side of said base portion of said intermediate section and is bent from the base portion at an acute angle with respect to the plane of said intermediate section and said contact section.

2. An electrical connector of claim 1, wherein said termination section, said intermediate section and said contact section are made of a single electrically conductive plate by a stamping and forming technique.

3. An electrical connector of claim 1, wherein said contact members are generally U-shaped.

4. An electrical connector of claim 1, wherein said acute angle of said termination section is 45 degrees.

5. An electrical connector comprising:

a dielectric housing having side walls, end walls, an upper wall and a bottom wall, said housing also having a plurality of apertures extending through the upper end bottom walls aligned in at least one row in parallel relationship to one another but at a desired acute angle with respect to the side and end walls of said dielectric housing; and a plurality of electrical contacts, each having a contact section to receive a contact pin therein, a termination section and an intermediate section interlinking said contact section and said termination section by way of a neck portion and a base portion;

wherein the contact and intermediate sections of said contacts are inserted and secured in said apertures and the termination sections extend outside of the side walls of said insulation housing at substantially a right angle with respect to the side walls due to the termination sections extending from the base portion at an acute angle with respect to the plane of the contact and intermediate sections.

6. An electrical connector of claim 5, wherein some of the termination sections extend in one side direction while the other terminal sections extend in the other side direction.

7. An electrical connector of claim 5, wherein the angle of said apertures in said dielectric housing is chosen to be substantially 45 degrees.

8. An electrical connector of claim 5, wherein said dielectric housing has a plurality of channels in the bottom wall in communication with said apertures for receiving the termination sections of said contacts.

9. An electrical connector of claim 5, wherein each of said contact is made of sheet metal by a stamping and forming technique with a slit formed between the termination section and the intermediate section from one side at substantially the bottom center portion of the intermediate section.

* * * * *